US005975542A

United States Patent [19]

Kaufman

[11] Patent Number: 5,975,542

[45] Date of Patent: Nov. 2, 1999

[54] HANGER FOR ROLLER SKATE HAVING SHOCK ABSORBING CHARACTERISTICS IN VERTICAL AND HORIZONTAL PLANES

[75] Inventor: Mark V. Kaufman, Stone Lake, Wis.

[73] Assignee: V-Line Skate, Co. Inc., Couderay, Wis.

[21] Appl. No.: 08/856,480

[22] Filed: May 14, 1997

[51] Int. Cl.[6] ..... A63C 17/00

[52] U.S. Cl. ..... 280/11.28; 280/842

[58] Field of Search ..... 280/11.27, 11.28, 280/11.22, 87.041, 87.042, 842; 16/31 R; 301/5.3, 5.7

[56] References Cited

U.S. PATENT DOCUMENTS

| | | | |
|---|---|---|---|
| 3,040,371 | 6/1962 | Rice et al. | 16/31 R |
| 4,066,272 | 1/1978 | Cobb | 280/11.28 |
| 4,229,855 | 10/1980 | Rowe | 16/31 R |
| 4,403,784 | 9/1983 | Gray | 280/11.28 |
| 4,708,352 | 11/1987 | Vullierme | 280/11.28 |
| 5,183,276 | 2/1993 | Pratt | 280/11.22 |
| 5,251,920 | 10/1993 | McHale | 280/11.27 |
| 5,342,071 | 8/1994 | Soo | 280/11.28 |
| 5,346,231 | 9/1994 | Ho | 280/11.22 |
| 5,348,321 | 9/1994 | Sbrilli | 280/11.27 |
| 5,566,957 | 10/1996 | Ho | 280/11.27 |

FOREIGN PATENT DOCUMENTS

| | | | |
|---|---|---|---|
| 8902914 | 6/1991 | Netherlands | 280/11.22 |

*Primary Examiner*—Lanna Mai
*Assistant Examiner*—Frank Vanaman
*Attorney, Agent, or Firm*—Julian C. Renfro, Esq.

[57] ABSTRACT

A wheel-supporting hanger for utilization on the frame of a roller skate, this hanger having an upper mounting portion as well as front and back portions. A central cavity is defined in the front portion of the hanger, in which an axle-receiving member is operatively mounted in a cantilever manner. A wheel-supporting axle protrudes outwardly in a cantilever manner from the axle-receiving member, with a screw utilized on the outer end of the axle for retaining a skate wheel in an operative manner on the axle. A structural member is located in an upper part of the cavity, defining a substantially flat undersurface in a relatively closely spaced relationship to the axle-receiving member. The cantileverly mounted axle-receiving member, because of the mounting of the axle therein, is permitted to flex upwardly as well as to move laterally to a controlled extent should the wheel mounted on the axle encounter an obstacle or obstruction. The axle-receiving member, in the instance of lateral movement, moves a commensurate distance with respect to the substantially flat undersurface, with this movement lessening the chance of material stress to the skate as a result of the shock of the skate wheel striking the obstacle. I prefer to utilize an insert of resilient, shock absorbing material between the axle-receiving member and the flat undersurface, with this insert being of selectable hardness so that the degree of permissible vertical travel of the axle can be closely controlled.

17 Claims, 2 Drawing Sheets

FIG 1
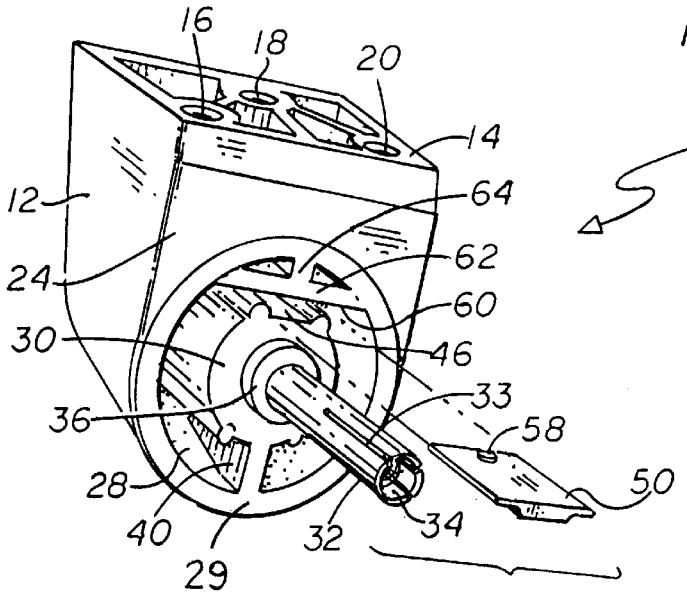
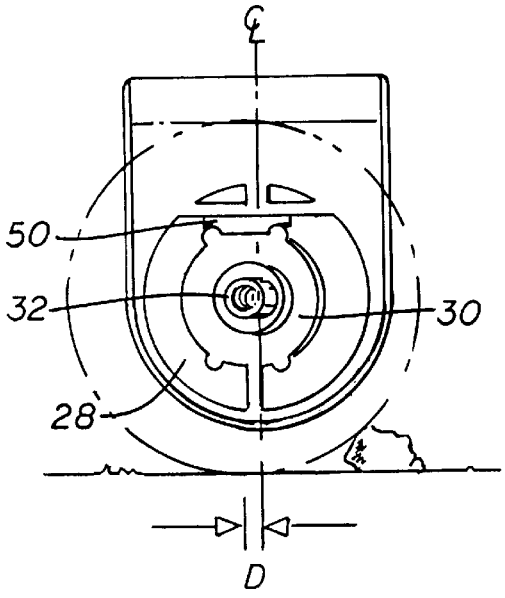
FIG 6a
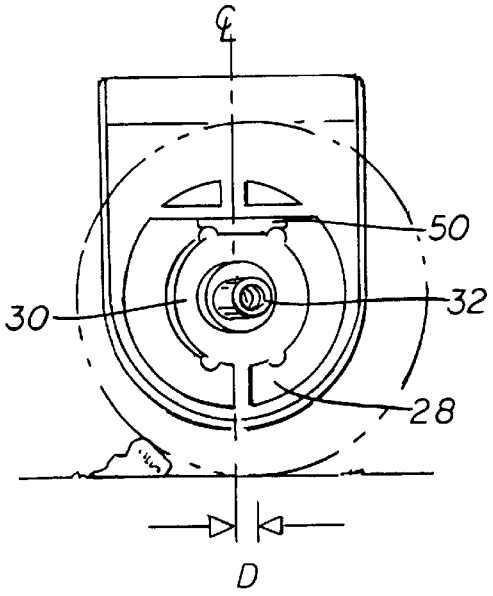
FIG 6b

HANGER FOR ROLLER SKATE HAVING SHOCK ABSORBING CHARACTERISTICS IN VERTICAL AND HORIZONTAL PLANES

BACKGROUND OF THE INVENTION

This invention relates to an improved wheel mounting bracket, also known as a hanger or truck, for use with a type of in-line or tandem roller skate using individually mounted wheels rather than wheels mounted as a group between parallel mounting plates, with this new hanger being designed to minimize the possibility of damage or stress to the frame of the skate should a wheel of the skate encounter an obstacle or obstruction, and to absorb vibrations, thus making the operation of this skate smoother and more pleasurable for the user.

Many generations of children and adults alike have enjoyed the pleasures of roller skating, and originally, the roller skates they used were of the so-called "quad" type, with each skate having a pair of wheels in the front, and a pair of wheels in the back.

For reasons of increased speed and maneuverability, a large number of skaters have entirely stopped using quad skates, and have gone over to what are called linear skates, involving a design wherein the wheels of each skate are disposed along a straight line. Linear or in-line skates have at least three wheels, but may utilize four, five or possibly more wheels, for as a generality, the larger the number of wheels, the smoother the ride.

Conventional in-line or linear roller skates normally utilize wheels positioned to rotate within a common vertical plane, and while operating as roller skates, have much of the feel and behavior associated with ice skates. Substantially the same bodily movements are required to operate both ice skates and in-line roller skates, and such roller skates have become increasingly popular with ice skaters as a desirable training tool for off season and on-street use. In recent years, in-line roller skates have been capturing an increasing share of the recreational skate market and in time may parallel jogging as a healthy and pleasurable adult sport.

In 1966, G. K. Ware in U.S. Pat. No. 3,287,023 disclosed an in-line skate with thin, rounded wheels which endeavored to simulate the performance of ice skates. The Ware skate utilized a fairly heavy metal frame having front and rear frame members with longitudinally extending and overlapping sections. Three sections had a multiplicity of horizontally arranged axle apertures which permitted positioning of wheel axles in a variety of different locations and provided continuous adjustability of the frame to accommodate a wide variety of boot sizes. The Ware frame also included the positioning of apertures at several elevations at the front and rear of the skate so that the forward and rear wheels could be a higher level than the two intermediate wheels. The Ware frame and variations of it are still in use on many types of currently available in-line roller skates.

A number of distinct wheel structures have been developed for use with tandem skates, conventional roller skates and other roller devices, some of which are shown in U.S. Pat. Nos. 189,783, 2,670,242, 4,054,335 and 4,114,952.

U.S. Pat. No. 5,303,940 entitled "Skate Having Angularly Mounted Wheels" was issued to Ernest E. Brandner on Apr. 19, 1994, with this skate representing a substantial departure from other in-line skates by utilizing wheel brackets attached to the undersurface of the mounting plate of the skate in such a manner as to cause the wheels of the skate to be disposed in a highly advantageous angled relationship. This Brandner patent described how the wheel mounting brackets or hangers could be mounted on the skate frame with all of the wheels mounted at the same angle, or alternatively, with the wheels mounted in an alternating angular relationship along the longitudinal axis of the mounting plate of the skate.

By the very nature of in-line skating, it is often conducted over rough, irregular, and debris filled surfaces. Therefore, it has become desirable to design hangers or wheel mounting brackets providing some shock absorbency, not only for the comfort for the skater, but also to lessen the likelihood of material stress within the frame of the skate.

The present invention is concerned with the construction of hangers or wheel mounting brackets generally similar to those taught in the above-identified Brandner patent, but with these new hangers having highly advantageous shock absorbing qualities in vertical and horizontal planes. Because of this advantageous construction, these novel hangers not only provide more comfort to the skater, but also lessen the likelihood of damage to the skate, should a wheel of the skate strike an obstacle or obstruction during use.

SUMMARY OF THE INVENTION

In accordance with this invention I have provided a wheel supporting hanger or wheel mounting bracket intended to be utilized on the frame of a roller skate for the support of a skate wheel. This novel hanger is constructed of resilient, somewhat flexible material, and it is configured to provide bidirectional shock absorbing characteristics, that is, shock absorbing characteristics in vertical as well as horizontal planes.

This novel hanger involves a housing member intended to be mounted on the frame of the skate, typically removably mounted, with this housing member having a substantially flat upper mounting portion designed to be secured to an appropriate portion of the skate frame. The hanger also has front and back portions, with means defining a central cavity in the front portion of the hanger, in which an axle-receiving member is defined. The central cavity may be regarded as being essentially surrounded by a generally cup-shaped member.

This axle-receiving member resides in the cavity in a cantilever manner, and an axle protrudes outwardly in a cantilever manner from this axle-receiving member. A tapped hole is provided on the centerline of the axle, into which a screw of appropriate length is intended to be threaded, in order that a skate wheel can be retained in an operative manner on the axle.

In accordance with this invention, an insert-receiving slot is defined in the cavity at a location directly above the axle-receiving member. Although for lightweight skaters it may be appropriate to permit a rather substantial amount of flexure to take place at this slot, typically I install an insert of shock absorptive material in the slot. A close-fitting relationship exists between the insert of shock absorptive material and the axle-receiving member, whereas a structural member in an upper part of the cavity defines a substantially flat surface at the top of the cavity, with which surface the insert of shock absorptive material is in slidable contact. Because of the mounting of the axle in the cantileverly mounted axle-receiving member, the axle is permitted to move laterally to a controlled extent should the wheel mounted on the axle encounter a pebble or other such obstacle, with the insert in this instance moving a commensurate lateral distance with respect to the flat surface defined at the top of the cavity. This advantageous arrangement is responsible for lessening the chance of material damage or fatigue of structural components of the skate as a result of the shock of the skate wheel striking the obstacle or obstruction.

In addition, because of the slot utilized above the axle-receiving member, the hanger is able to flex in a vertical direction, thus to provide an additional shock absorbing characteristic, in an orthogonal relationship to the shock absorbing characteristic in a lateral or left-right direction. As is obvious, somewhat less hanger flexure can take place at the slot location when an insert of shock absorbing material is utilized in the slot.

It is also to be noted that the substantially flat upper cavity member is configured to permit a degree of flexing, with this constructional characteristic enhancing the axle being able to flex vertically and thus provide increased comfort to the skater.

It is thus a primary object of my invention to provide a novel wheel-supporting hanger or wheel mounting bracket for a roller skate equipped with a cantileverly mounted axle upon which a skate wheel is operatively installed, with the hanger possessing bidirectional shock absorbing characteristics in that it permits a degree of axle flexure in a vertical direction, as well as axle flexure in a horizontal direction should the wheel encounter a pebble or other obstruction.

It is another object of my invention to provide a novel wheel-supporting hanger for a roller skate equipped with an axle upon which a skate wheel is operatively installed, in which the hanger is configured to permit a degree of axle movement in a fore and aft direction, that is, movement parallel to the base plate of the skate, thereby lessening the transmittal of shock to the base plate, thus to minimize the possibility of damage or stress to the skate.

It is yet another object of my invention to provide a novel wheel-supporting hanger for a roller skate equipped with an axle upon which a skate wheel is operatively installed, with a slot provided in the hanger into which shock absorbing material may be inserted, thus to help insulate the foot of the skater from vibration and thereby increase the skater's comfort.

It is yet still another object of my invention to provide a novel wheel-supporting hanger for a roller skate equipped with an axle upon which a skate wheel is operatively installed, with the axle extending outwardly in a cantilever manner from a cavity defined in the hanger, with a flexure member defined in an upper part of the cavity being designed to permit a degree of flexure of the axle in a vertical direction, thus to contribute to the comfort of the skater.

These and other objects, features and advantages will be more apparent from the enclosed drawings.

BRIEF DESCRIPTION OF DRAWINGS

FIG. 1 is a perspective view of a typical hanger or wheel mounting bracket for a roller skate in accordance with my invention, with this view revealing an insert-receiving slot in which a piece of shock absorbing material may be received, with it being important to understand that this novel hanger is designed to have shock absorbing characteristics in vertical and horizontal planes;

FIG. 6*a* is a view of my novel hanger showing the right edge of a wheel supported by the axle having contacted an obstruction such as a pebble, thus bringing about axle motion, depicted here to the left in a somewhat exaggerated manner, with this permissible motion serving to isolate the frame of the skate from shock; and FIG. 6*b* is a view similar to FIG. 6*a* but here showing, also in a somewhat exaggerated manner, the opposite side of the skate wheel having contacted an obstruction such as a pebble, with this view presuming the hanger is utilized on another part of the skate frame than the hanger depicted in FIG. 6*a,* with the axle in this instance pointing in the opposite direction from the axle depicted in FIG. 6*a*.

DETAILED DESCRIPTION

Figure 3:
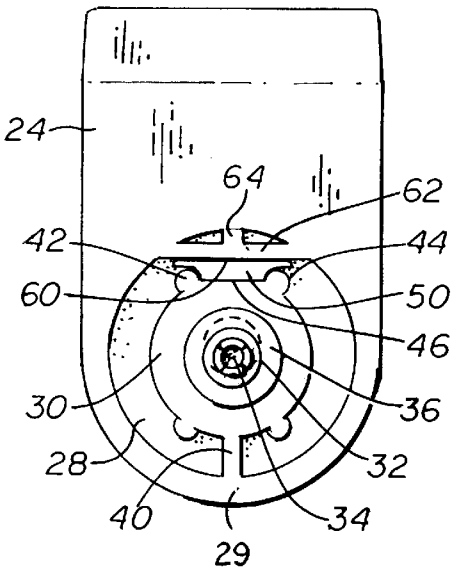
FIG. 3 is a view looking directly at the end of the wheel-receiving axle so as to reveal other significant details, including the generally cup-shaped member serving to help define the cavity essentially surrounding the axle-receiving member of my novel hanger.

With reference to FIG. 1, it will be seen that I have depicted a perspective view of my novel wheel supporting hanger or wheel mounting bracket 10 intended to be utilized on the frame of a roller skate for the support of a skate wheel. Although the hanger could be directly molded to the frame of the skate, I typically prefer for the hanger or wheel mounting bracket to be removably attached to the frame of the skate, in a manner shortly to be described.

It is to be noted that although my novel hanger 10 is entirely suitable for use on a linear skate or in-line skate having wheels disposed at a conventional 90° angle, I prefer for this hanger to be utilized on the frame of a skate in accordance with the Brandner U.S. Pat. No. 5,303,940 entitled "Skate Having Angularly Mounted Wheels," wherein the wheels are mounted in an angularly disposed relationship to the frame of the skate.

From the above-identified Brandner patent it is to be seen that as one option, the hangers may be mounted on the skate frame in an alternating array with a first wheel supporting axle directed to the right; the second wheel supporting axle directed to the left; the third wheel supporting axle directed to the right; and the fourth wheel supporting axle directed to the left.

The hanger 10 in accordance with the instant invention involves a housing member 12 constructed of a resilient, somewhat flexible material such as polyurethane, although I obviously am not to be limited to this material. Inasmuch as the hanger 10 illustrated in FIG. 1 is intended to be removably mounted on the frame (not shown) of a skate, I provide a substantially flat portion 14 designed to be placed against and secured to an appropriate undersurface of the skate frame. The flat portion 14, hereinafter to be regarded as the mounting surface, is provided with a plurality of tapped holes 16, 18 and 20, with hole 18 in alignment with the centerline of the hanger and with the axle 32 cantileverly supported in a shock-absorptive manner by the hanger 10. By the use of a plurality of screws of suitable length, not shown, the hanger 10 is to be secured to the frame of the skate, passing through holes of suitable diameter in the skate frame that are spaced in accordance with the spacing of the holes 16, 18 and 20.

Figure 2:
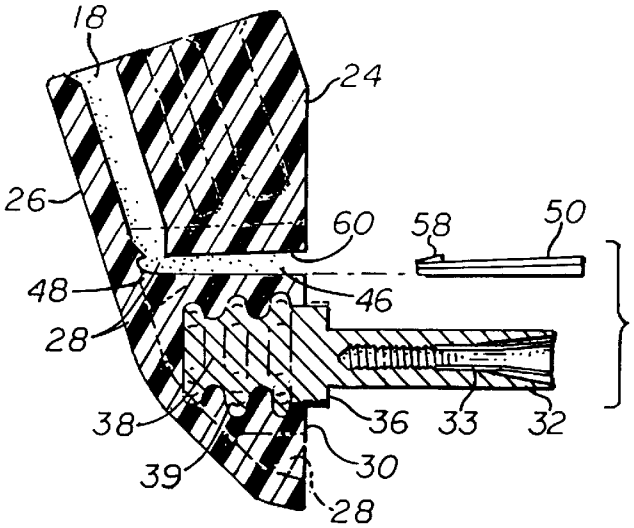
FIG. 2 is a side view of the hanger shown in FIG. 1, with this view revealing in greater detail, the construction in which the slot arranged to receive a shock absorbing insert is located above the cantileverly mounted axle-receiving member in which the axle is disposed.

The hanger 10 has a front surface 24 and a rear surface 26, latter being visible in FIG. 2, with each of these surfaces being in contact with the mounting surface 14. Defined in the front surface 24 of the hanger 10 is a cavity 28 in which an axle-receiving member 30 is mounted, with this cavity being visible in FIGS. 1, 3, 6*a* and 6*b*. With particular reference to FIG. 3 it will be seen that the curved wall 29 may be regarded as defining at least a part of a generally cup-shaped outer wall around the cavity 28. This generally cup-shaped outer wall can of course flex when the skate is in use, thus to add comfort to the skater.

The axle-receiving member 30 is located in the cavity 28, extending in a cantilever manner outwardly from what may be regarded as the rear surface 26 of the hanger. Molded in the centrally disposed axle-receiving member 30 is the axle 32 of steel that protrudes outwardly in a cantilever manner, as revealed in FIGS. 1, 2 and 4. The axle 32 is preferably a split axle created along the lines of the axle described in the international patent application of Ernest E. Brandner, International Publication No. WO 96/36531, which was published Nov. 21, 1996. This Brandner patent application teaches that the axle of that application is configured to hold a skate wheel in the operative position by virtue of the end of the axle being split so as to be expandable. In accordance with the teaching of that Brandner application, a tapped hole is formed in the end of the axle, with the tapped hole located along the centerline of the axle. A tightening screw is utilized for expanding the diameter of the axle when the skate wheel is in place, such that the wheel will be securely held in an operative manner on the axle.

With continued reference to FIG. 1 of the instant invention, it will be noted that the steel axle 32 contains one or more slits or slots 33 extending from the outward end of the axle in the direction of an integral shoulder 36. The shoulder 36 is formed on the inner portion of the part of the axle upon which the skate wheel is to reside. Disposed on the centerline of the axle 32 is a tapped hole 34 into which a screw of appropriate length is intended to be threaded, in order to cause the outer end of the axle to expand, and thus cause a skate wheel to be retained in an operative manner on the axle 32.

Figure 4:
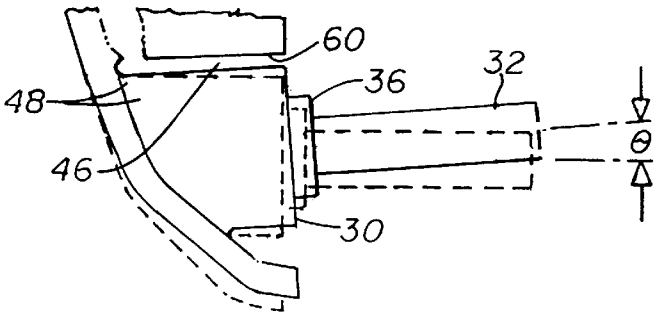
FIG. 4 is a view bearing some resemblance to FIG. 2, with this view revealing, in a somewhat exaggerated manner, that my novel hanger design serves to create a flexure location at which some vertical motion of the axle is permitted.

From FIGS. 1, 2 and 4 it will be seen that the aforementioned integral shoulder 36 bears directly against the centrally disposed axle-receiving member 30. Inasmuch as the axle-receiving member 30 extends in the cavity 28 in an essentially unsupported manner outwardly from the rear surface 26, I may provide a supporting web 40 on the undersurface of the axle-receiving member 30, as is clearly visible in FIGS. 1 and 3. I have found that the provision of the web 40 helps prevent distortion from occurring during the molding of the hanger. Also, while providing some stability to the axle-receiving member 30, it is to be noted that web 40 does not inhibit left-right movement or flexure of the member 30 in the manner described hereinafter with regard to FIGS. 6*a* and 6*b*.

Important to this invention is the fact that a slot 46 is defined in the cavity 28, disposed directly above the axle-receiving member 30, with the slot 46 being visible in FIG. 1, as well as being visible in FIGS. 2 through 4. It is in the slot 46 that I may utilize means in the form of resilient, shock-absorptive material in order to advantageously provide shock absorbing characteristics in vertical and horizontal planes for my novel hanger.

Figure 5:
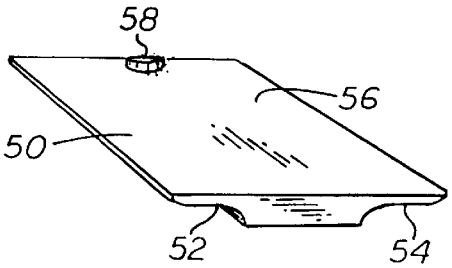
FIG. 5 is a view to a larger scale of the insert I utilize to provide shock absorbing characteristics to my novel hanger.

It is to be noted that my novel hanger may be utilized without any shock absorbing means installed in the slot, such as when the skater is of light weight. However, in a large number of instances I prefer to utilize shock absorbing means in the slot, with this means taking the form of an insert 50 of suitable material, typically of plastic. This insert is to be installed in the general manner indicated in FIG. 1, in order to bring about some of the highly desirable shock-absorptive characteristics of my novel hanger. Although visible in FIGS. 1 and 2, the insert 50 is best seen in FIG. 5, and this component will be discussed at greater length hereinafter.

It is to be understood, however, that for lightweight skaters it is possible to omit the use of the insert 50, thus to permit a rather substantial amount of flexure to take place at the slot location, with this flexure to take place as a consequence of constructing the hanger out of resilient, somewhat flexible material.

From FIG. 2 it will be seen that the axle 32 is provided with an interior supporting portion 38 involving two, three or more convolutions 39, which serve to hold the axle firmly in the axle-receiving central member 30 of the hanger. I typically knurl or notch the peripheries of the convolutions 39 of the interior portion 38 in order that the axle 32 will not tend, during use, to rotate with respect to the hanger. The axle-receiving member 30 of the hanger 10 is typically molded around the interior portion of the axle 32 during an injection molding procedure.

With reference to FIG. 3, it will be noted that protuberances 42 and 44 are formed in a spaced-apart relationship upon upper portions of the axle-receiving central member 30, with these protuberances serving in part to define the aforementioned insert-receiving slot 46.

Spaced above these protuberances 42 and 44 is a flat surface 60 which will be noted in FIG. 3 to have substantial width in the left-right direction. The flat surface 60 is located on a laterally extending structural member 62 that may be regarded as defining an upper portion of the cavity 28, and because of its location, I may hereinafter refer to the surface 60 as an undersurface. In a central location above the structural member 62 is a supporting web 64, which is in direct contact with a surrounding portion of the housing 12. Because the structural member 62 is supported only at its edges, and by the web 64 in its central portion, the structural member 62 may undertake a desirable amount of flexure when the skate is in use.

It is to be noted that when no preformed insert is being utilized in the slot 46 during use of the skate, the protuberances 42 and 44 may come into contact with the undersurface 60 at unsupported locations of the member 62, with this of course meaning that significant flexure of the member 62 can take place in such instances.

Referring back to FIG. 2, it will be noted that the flat surface 60 bears a slightly tapered relationship to the upper surface of the axle-receiving central member 30, with this making it possible to define a type of wedge-shaped configuration. It is at least partly because of this relationship that the preformed insert 50 may be effectively maintained in the slot 46 that exists between the upper surface of the central member 30 and the flat undersurface 60 of the structural member 62.

With reference now to FIG. 4, it will be seen that at this location I depict, in a somewhat exaggerated manner for reasons of clarity, a controlled amount of vertical movement $\Theta$ of the outer end of the axle 32, which movement is about flexure point 48 located at the rear of the hanger 10. It was earlier seen that cavity 28 defined at least in part by the cup-shaped member 29 extends almost entirely around the axle-receiving central member 30, with the result that flexure point 48 may be regarded as being in somewhat the configuration of an inverted "U". As is obvious, this flexure of the axle contributes substantially to the comfort of the skater.

Turning to FIG. 5 it will be noted that the underside of the preformed insert 50 has long edges 52 and 54, which are of substantially constant thickness and which extend for the length of the insert 50. In contrast with this, the upper surface 56 of the insert 50 is flat, except for a protrusion 58 at the end of the upper surface, located on the centerline of 50, which protrusion is to be described shortly.

With reference to FIG. 3 in the context of FIG. 5, it is important to note that the long edge 52 of the insert 50 is to come into contact with protuberance 42, and the long edge 54 of the insert is to come into contact with the protuberance 44 at such time as the insert 50 is to be installed in the slot 46. Because of this construction, the insert 50 may be regarded as having a firm relationship with the axle-receiving central member 30 of the hanger, with little if any relative motion being present at this location when the skate is in use.

A particularly important aspect of this invention involves the fact that the upper surface 56 of the insert 50 as well as the undersurface 60 of the structural member 62 are both flat, although it is to be noted that in some instances, the undersurface 60 could possess a desirable amount of curvature. Because of this relative flatness, a desirable amount of relative motion of the axle 32 in a lateral or left-right direction is permitted in the event of a shock. Such a shock may occur at such time as a skate equipped with my novel hanger has been placed in use, and the axle 32 has encountered an event, such as the wheel installed on the axle coming into sudden contact with a pebble or some other obstruction. This will be discussed hereinafter with regard to FIGS. 6*a* and 6*b*.

Because of the relative motion that is advantageously possible between the upper surface 56 of the insert 50 and the flat undersurface 60, the axle-receiving central member 30 can, during use of the skate, move to some extent in a rearward direction with respect to the laterally extending structural member 62 of the housing member, thus avoiding a substantial portion of shock being transmitted to the frame of the skate. Through many tests I have established that the sliding motion made possible, in accordance with this novel design, between the flat upper surface of the insert 50 and the underside of the structural member 62 may in many instances lessen the possibility of damage, shock or stress to the skate frame.

With further reference to FIG. 5 it will be noted that upon a rear location on the upper flat surface 56 of the insert 50 is the aforementioned protrusion 58, which is utilized as a locking member serving to prevent dislocation of the insert 50 during use of the skate. With reference to FIG. 2, it is to be noted that the protrusion 58 is designed to coincide with the location of the lowermost portion of the rear mounting hole 18, and thus serves to lock the insert 50 in its operative position. I have found that a protrusion 58, being located at the innermost portion of the insert 50, does not interfere in any consequential manner with the sliding type relative motion of the insert 50 with the undersurface 60, but as is obvious, the lowermost portion of the hole 18 could be widened in a lateral direction should this for any reason become necessary.

I am not to be limited to any one substance or compound in the creation of the insert 50 of resilient, shock absorptive material, but typically I construct this member of polyurethane. Other options may include the creation of the insert 50 from polyethylene, polypropylene or relatively dense rubber. It has already been pointed out that under certain circumstances my novel hanger, because of its unique structural design, may be utilized without a preformed insert.

Turning now to FIGS. 6*a* and 6*b*, it will be noted in FIG. 6*a* that I have illustrated, in a somewhat exaggerated manner, how if the lower right edge of the wheel supported on the axle 32 strikes a pebble or the like, the axle is permitted to deflect laterally to the left in this instance, for a distance D. This lateral deflection of the axle is made possible by the fact that the axle-receiving member 30 of the hanger is supported in a substantially cantilever fashion from the rear portion 26 of the hanger, with the flat upper surface 56 of the insert 50 being, as previously explained, in a sliding relationship with the undersurface 60, located of course on the underside of the structural member 62. Because of this sliding relationship, the axle 32 is not inhibited from moving laterally in the manner indicated by letter D in FIG. 6*a*, upon the skate wheel striking an obstruction.

Somewhat similarly, in FIG. 6*b* I have shown the left lower surface of the wheel striking a pebble, with this causing the axle to move laterally, in this instance to the right to an extent D. As before, the flat surface 56 of the insert 50 can advantageously move in a sliding manner with respect to the relatively flat undersurface 60 of the structural member 62.

As will be apparent to those skilled in this art, the situation depicted in FIG. 6*b* may come about when the skater is skating rearwardly, or it may come about because the hanger depicted in FIG. 6*b* is mounted on the skate frame such that its axle is pointing in substantially the opposite direction from the axle shown on the hanger depicted in FIG. 6*a*.

It should now be seen that my invention permits the creation of a novel hanger or wheel mounting bracket for a skate, which hanger has highly advantageous bidirectional shock absorbing characteristics serving to help protect the skate frame from stress as well as contributing markedly to the comfort of the skater.

Despite the fact that I have specifically referred to vertical motion and horizontal motion of the cantileverly supported axle, it is to be understood that the construction of my novel hanger is such as to permit motion of the axle to the left and upward, to the right and upward, as well as other combinational movements.

Although I have described the insert 50 as being locked in place by the protrusion 58 aligning with the rear mounting hole 18, by inserting a long thin item down the hole 18 after the hanger has been removed from the skate, the protrusion 58 can be released from its locking relationship so that the insert can be entirely removed. It is within the spirit of my invention to standardize the size of the inserts, so that a selected insert of the desired degree of hardness or firmness can be utilized in a given instance, so that the permissible vertical travel of the axle can be closely controlled. For example, the weight of the skater may well determine the character of the insert.

I claim:

1. For use in connection with a roller skate having a frame, a wheel-supporting hanger for utilization on the frame of the roller skate, said hanger having an upper mounting portion as well as front and back portions, means defining a central cavity in said front portion of the hanger in which an axle-receiving member is defined, said axle-receiving member residing in said cavity in a cantilever manner, a wheel-supporting axle protruding outwardly in a cantilever manner from said axle-receiving member, means on the outer end of said axle for retaining a skate wheel in an operative manner on said axle, means defining a slot in said hanger above said axle-receiving member in which resilient, shock-absorptive material may optionally be received, such resilient material enabling flexure of said hanger in a manner permitting vertical movement of said axle in a shock absorptive manner.

2. The wheel-supporting hanger as recited in claim 1 in which slot, resilient, shock-absorptive material in the configuration of a pre-formed insert can be slidably installed.

3. The wheel-supporting hanger as recited in claim 2 in which locking means are provided on said insert, to enable the locking of said insert in said slot in a releasable manner.

4. The wheel-supporting hanger as recited in claim 2 in which a structural member is defined in an upper portion of said cavity and having thereon a substantially flat undersurface, said structural member being located above said axle-receiving member, with which undersurface said insert of shock absorptive material is in slidable contact, said axle, because of the mounting of said axle in said cantileverly mounted axle-receiving member, being permitted to move laterally to a controlled extent should a wheel mounted on said axle encounter an obstacle or obstruction, with said insert in such instance moving a commensurate distance with respect to said substantially flat undersurface defined in the upper portion of said cavity, with the permissible movement of said axle lessening the chance of material stress to the skate as a result of the shock of the skate wheel striking the obstacle or obstruction.

5. The wheel-supporting hanger as recited in claim 4 in which the undersurface of said axle-receiving member has a supporting web for providing stability to said axle-receiving member during lateral movement of said axle.

6. For use in connection with a roller skate having a frame, a wheel-supporting hanger for utilization on the frame of the roller skate, said hanger having an upper mounting portion as well as front and back portions, means defining a central cavity in said front portion of the hanger, in which an axle-receiving member is operatively mounted, said axle-receiving member residing in said cavity in a cantilever manner, a wheel-supporting axle protruding outwardly in a cantilever manner from said axle-receiving member, means on the outer end of said axle for retaining a skate wheel in an operative manner on said axle, a structural member in an upper part of said cavity, residing in a generally parallel relationship to said upper mounting portion, said structural member defining a substantially flat undersurface in a relatively closely spaced relationship to said axle-receiving member, said cantileverly mounted axle-receiving member, because of the mounting of said axle therein, being permitted to flex upwardly as well as to move laterally to a controlled extent should a wheel mounted on said axle encounter an obstacle or obstruction, said axle-receiving member, in the instance of lateral movement, moving a commensurate distance with respect to said substantially flat undersurface, with this movement lessening the chance of material stress to the skate as a result of the shock of the skate wheel striking the obstacle or obstruction.

7. The wheel-supporting hanger as recited in claim 6 in which an insert-receiving slot is defined between said axle-receiving member and said undersurface, said slot configured to receive a substantially flat insert therein, said insert residing in a slidable relationship to said substantially flat undersurface, so that relative lateral motion can occur should the wheel strike an obstacle or obstruction.

8. The wheel-supporting hanger as recited in claim 7 in which said insert to be installed in said slot is made of resilient, shock absorptive material, said hanger being able to flex to some extent in a vertical direction, thus to provide an additional shock absorbing characteristic in an orthogonal relationship to the shock absorbing characteristic in a lateral direction.

9. The wheel-supporting hanger as recited in claim 8 in which locking means are provided on said insert, to enable the locking of said insert in said slot in a releasable manner.

10. For use in connection with a roller skate having a frame, a wheel-supporting hanger for utilization on the frame of the roller skate, said hanger having an upper mounting portion as well as front and back portions, means defining a central cavity in said front portion of the hanger, in which an axle-receiving member is defined, said axle-receiving member residing in said cavity in a cantilever manner, a wheel-supporting axle protruding outwardly in a cantilever manner from said axle-receiving member, means on the outer end of said axle for retaining a skate wheel in an operative manner on said axle, an insert-receiving slot defined in said cavity at a location directly above said axle-receiving member, for receiving therein an insert of resilient, shock-absorptive material with a close-fitting relationship existing between said insert of shock absorptive material and said axle-receiving member, a structural member located in an upper part of said cavity and defining a substantially flat undersurface, with which undersurface said insert of shock absorptive material is in slidable contact, said axle, because of the mounting of said axle in said cantileverly mounted axle-receiving member, being permitted to move laterally to a controlled extent should a wheel mounted on said axle encounter an obstacle or obstruction, with said insert in such instance moving a commensurate distance with respect to said substantially flat undersurface defined at the upper part of said cavity, with this permissible movement lessening the chance of material stress to the skate as a result of the shock of the skate wheel striking the obstacle or obstruction.

11. The wheel-supporting hanger as recited in claim 10 in which locking means are provided on said insert, to enable the locking of said insert in said slot in a releasable manner.

12. The wheel-supporting hanger as recited in claim 10 in which a supporting web is provided on the undersurface of said axle-receiving member, for providing stability to said axle-receiving member during lateral flexure.

13. For use in connection with a roller skate having a frame, a wheel supporting hanger intended to be utilized on the frame of the roller skate for the support of a skate wheel, said hanger involving a housing member intended to be removably mounted on the frame of the skate and including a substantially flat mounting portion designed to be placed against an appropriate portion of the skate frame, a plurality of tapped holes provided for mounting purposes in said mounting portion, said hanger having front and rear portions, means defining an axle-receiving central member extending from said front portion of said hanger, with said axle-receiving central member supported from a location relatively near the rear surface of said hanger, an axle protruding outwardly from said axle-receiving central member in a cantilever manner, means defining a slot in said hanger above said axle-receiving member, in which resilient, shock-absorbing means may optionally be received, a tapped hole provided on the centerline of said axle, into which a screw of appropriate length is intended to be threaded, in order that a skate wheel can be retained in an operative manner on the axle, a supporting web on the undersurface of said axle-receiving central member, said shock absorbing means being utilized for providing improved comfort for a skater.

14.The wheel supporting hanger for the support of a skate wheel as recited in claim 13 in which said shock absorbing means is an insert of resilient, shock-absorbing material, received in said slot mounted above and in direct contact with said axle-receiving central member.

15. The wheel-supporting hanger as recited in claim 14 in which locking means are provided on said insert, to enable the locking of said insert in said slot in a releasable manner.

16. For use in connection with a roller skate having a frame, a wheel-supporting hanger for utilization on the frame of the roller skate, said hanger being of somewhat flexible, resilient material and having an upper mounting portion as well as front and back portions, means defining a central cavity in said front portion of the hanger in which an axle-receiving member is defined, said axle-receiving member residing in said cavity in a cantilever manner, a wheel-supporting axle protruding outwardly in a cantilever manner from said axle-receiving member, a structural member disposed in an upper part of said cavity, residing in a generally parallel relationship with said upper mounting portion, said structural member defining a substantially flat undersurface in a relatively closely spaced relationship to said axle-receiving member, an insert-receiving slot defined between said axle-receiving member and said undersurface, said slot configured to receive a substantially flat insert therein, said insert residing in a slidable relationship to said substantially flat undersurface, so that relative lateral motion can occur should a wheel mounted on said axle strike an obstacle or obstruction, means on the outer end of said axle for retaining a skate wheel in an operative manner on said axle, said axle being able, during use, to undertake vertical movement so as to provide a degree of shock absorption for the user.

17. The wheel-supporting hanger as recited in claim 16 in which said insert is of shock absorptive material, such that when inserted into said slot, said insert provides a distinct shock absorptive function for said hanger, during such vertical movement.

* * * * *